US010577566B2

(12) United States Patent
Kropf et al.

(10) Patent No.: US 10,577,566 B2
(45) Date of Patent: Mar. 3, 2020

(54) 6-DESOXY-6-AMINO-CELLULOSES AS SOIL RELEASE AGENTS

(71) Applicant: Henkel AG & Co. KGaA, Duesseldorf (DE)

(72) Inventors: Christian Kropf, Hilden (DE); Frank Janssen, Cologne (DE); Mareile Job, Leverkusen (DE); Christa Junkes, Duesseldorf (DE); Anja von Kathen, Wuppertal (DE); Thomas Heinze, Jena (DE); Kristin Ganske, Jena (DE)

(73) Assignee: Henkel AG & Co. KGaA (DE)

( * ) Notice: Subject to any disclaimer, the term of this patent is extended or adjusted under 35 U.S.C. 154(b) by 0 days.

(21) Appl. No.: 16/057,091

(22) Filed: Aug. 7, 2018

(65) Prior Publication Data

US 2018/0346846 A1 Dec. 6, 2018

Related U.S. Application Data

(63) Continuation of application No. PCT/EP2017/052188, filed on Feb. 2, 2017.

(30) Foreign Application Priority Data

Feb. 12, 2016 (DE) ..... 10 2016 202 143

(51) Int. Cl.
*C11D 3/22* (2006.01)
*C11D 3/00* (2006.01)

(52) U.S. Cl.
CPC ..... *C11D 3/227* (2013.01); *C11D 3/0036* (2013.01)

(58) Field of Classification Search
CPC ..... C11D 1/662; C11D 3/22; C11D 3/227; C11D 3/228
See application file for complete search history.

(56) References Cited

U.S. PATENT DOCUMENTS 4,000,093 A 12/1976 Nicol et al.
4,136,038 A 1/1979 Pracht et al.
4,531,000 A * 7/1985 Yalpani ..... C08B 15/06 536/14
2010/0075887 A1 3/2010 Wang et al.
2012/0065114 A1* 3/2012 Bettiol ..... C07C 251/24 510/103
2014/0316128 A1* 10/2014 Granstrom ..... C08B 15/06 536/30

FOREIGN PATENT DOCUMENTS

| | | | | | |
|---|---|---|---|---|---|
| DE | 473097 | C | | 3/1929 | |
| DE | 2412837 | A1 | | 10/1974 | |
| EP | 0213729 | A1 | | 3/1987 | |
| EP | 0213730 | A1 | | 3/1987 | |
| GB | 495097 | | * | 11/1938 | ..... C08B 15/06 |
| GB | 495097 | A | | 11/1938 | |
| GB | 2360791 | A | | 10/2001 | |
| SU | 473724 | | * | 6/1975 | ..... C08B 15/06 |
| SU | 473724 | | * | 1/1976 | ..... C08B 15/06 |
| SU | 473724 | A1 | * | 1/1976 | ..... C08B 15/06 |
| WO | 0018860 | A1 | | 4/2000 | |
| WO | 0018861 | A1 | | 4/2000 | |
| WO | 0172937 | A1 | | 10/2001 | |
| WO | 0172944 | A1 | | 10/2001 | |

OTHER PUBLICATIONS

Rahn, Kerstin et al., "Homogeneous synthesis of cellulose p-toluenesulfonates in N,N-dimethylacetamide/LiCl solvent system", Die Angewandte Makromolekulare Chemie, vol. 238, No. 1, pp. 143-163, Huethig & Wepf Verlag, Zug 1996.
PCT International Search Report PCT/EP2017/052188 Completed: Apr. 6, 2017; dated Apr. 18, 2017 2 pages.

* cited by examiner

*Primary Examiner* — Brian P Mruk
(74) *Attorney, Agent, or Firm* — Thomas G. Krivulka

(57) ABSTRACT

Compositions and methods to improve the cleaning performance of washing agents during laundering of textiles are disclosed. Compositions described use 6-desoxy-6-amino-celluloses. Methods for laundering textiles, in which a detergent and a soil release active ingredient are used in the form of a cellulose derivative as defined above, are also included. These methods can be performed manually or as appropriate with the aid of a conventional domestic washing machine.

5 Claims, No Drawings

6-DESOXY-6-AMINO-CELLULOSES AS SOIL RELEASE AGENTS

FIELD OF THE INVENTION

The present invention relates to the use of certain soil release active ingredients for improving the cleaning performance of detergents during laundering of textiles.

BACKGROUND OF THE INVENTION

In addition to the ingredients indispensable for the washing process, such as surfactants and builder materials, detergents generally also contain further constituents, which can be summarized under the term washing auxiliaries and which comprise active ingredient groups as diverse as those such as foam regulators, anti-graying agents, bleaching agents, bleach activators, and dye transfer inhibitors. Auxiliaries of this type also include substances which give the laundry fibers dirt-repelling properties and which, if present during the washing process, support the dirt-repelling capability of the other detergent constituents. The same is also true, analogously, for cleaning products for hard surfaces. Dirt-repelling substances of this type are often referred to as "soil release" active ingredients or, on account of their ability to make the treated surface, for example the fibers, dirt-repelling, are referred to as "soil repellents". For example, the dirt-repelling effect of methyl cellulose is known from US patent U.S. Pat. No. 4,136,038. European patent application EP 0 213 729 discloses the reduced redeposition with use of detergents that contain a combination of soap and non-ionic surfactant with alkyl hydroxyalkyl cellulose. Textile treatment agents which contain cationic surfactants and non-ionic cellulose ethers with HLB values of from 3.1 to 3.8 are known from European patent application EP 0 213 730. US patent specification U.S. Pat. No. 4,000,093 discloses detergents that contain 0.1 wt. % to 3 wt. % of alkyl cellulose, hydroxyalkyl cellulose, or alkyl hydroxyalkyl cellulose, and 5 wt. % to 50 wt. % of surfactant, wherein the surfactant component consists substantially of $C_{10}$ to $C_{13}$ alkyl sulfate and up to 5 wt. % of $C_{14}$ alkyl sulfate, and less than 5 wt. % of alkyl sulfate with alkyl groups of $C_{15}$ and higher.

Due to their chemical similarity to polyester fibers, particularly effective soil release active ingredients in textiles made of this material are copolyesters containing dicarboxylic acid units, such as terephthalic acid or sulfoisophthalic acid, alkylene glycol units, such as ethylene glycol or propylene glycol, and polyalkylene glycol units, such as polyethylene glycol. Soil release copolyesters of the aforesaid type and use thereof in detergents have long been known.

The polymers known from the prior art have the disadvantage that they do not have any efficacy, or have only inadequate efficacy in particular in textiles that are not made of polyester, or are not made primarily of polyester. A large amount of modern textiles, however, are made of cotton or cotton-polyester blended fabrics, and there is thus a need for soil release active ingredients that have improved efficacy in particular in the case of grease stains in particular on textiles of this kind.

It has surprisingly been found that this problem can be solved by the use of certain cellulose derivatives.

International patent application WO 00/18860 A1 discloses the rebuilding effect of what are called cellulose esters in that document, which can also be cellulose carbamates, on textiles. This is supposedly based on the fact that the cellulose esters are deposited on the damaged textile areas, react with the fibers by cleaving of the reactive ester functionality, and thus strengthen the damaged areas by cellulose. It is known from international patent application WO 00/18861 A1 that cellulose esters of this kind increase the affinity of material to be deposited on a substrate, such as a fiber, for said substrate. International patent application WO 01/72937 A1 relates to the reduction of dye losses when laundering dyed textiles by virtue of the use of cellulose esters of this kind. International patent application WO 01/72944 A1 discloses the suitability of cellulose ethers of this kind to increase the deposition of fragrances on textiles, and it is known from patent application GB 2 360 791 A that they contribute to fabric softness by virtue of their deposition on textiles.

BRIEF SUMMARY OF THE INVENTION

The subject of the invention is the use of cellulose derivatives that contain a modified anhydroglucose unit of general formula I

I

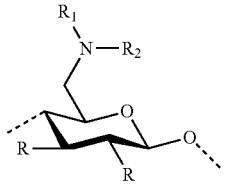

in which the groups R stand independently of one another for H, $OR^1$, $OC(O)R^1$, $O(CH_2)_nCOOX$, $O(CH_2)_nSO_3X$ with n=1-4 or p-toluene sulfonate, and X stands for H or an alkali metal ion, and $R^1$ and $R^2$ stand independently of one another for —H, aryl groups, straight-chain or branched alkyl, aryl, alkylaryl or arylalkyl groups, which can be substituted with one or more functional groups, in particular hydroxy groups, carboxylic acid groups and/or sulfonic acid groups, wherein the aforesaid acids can also be present wholly or partially in salt form, and/or in which a C atom or a plurality of non-adjacent C atoms can be replaced by heteroatoms, such as N, O or S, or $R^1$ and $R^2$ together with the N atom to which they are bonded form a 4 to 7-membered aliphatic or aromatic ring, which, besides the aforesaid N atom, can also comprise one or more further heteroatoms, such as N, O or S, to enhance the cleaning performance of detergents during the laundering of textiles.

6-desoxy-6-amino celluloses are accessible by known production methods, for example by a two-stage synthesis consisting of the conversion of cellulose with p-toluene sulfonic acid chloride, as described in Angew. Makromol. Chem. [Appl. Macromol. Chem.] 238 (1996) 143-163, into cellulose tosylates and subsequent aminolysis of the tosylates with amines of the $H—NR^1R^2$ type to give the corresponding 6-amino-6-amino-cellulose derivatives. Any tosyl groups still present can then be removed hydrolytically wholly or at least in part (which leads to compounds that contain groups with R═OH) or by substitution with hydride ions (which leads to compounds that contain groups with R═H), in particular if the reaction of the first stage led to tosylations at positions other than at the OH group in position 6 of the cellulose anhydroglucose units. If it is not cellulose that is used as starting material, but instead correspondingly substituted cellulose, compounds of general formula (I) with R≠H and R≠OH are obtainable analogously, these can also be obtained from the cellulose tosylate produced after the first-mentioned step above and reaction of the free OH groups thereof with alkylation or esterification reagents in the known manner. Modified anhydroglucose units of general formula I are preferably those in which $R^1$ and $R^2$ are selected, independently of one another, from H, methyl, ethyl, propyl, isopropyl,

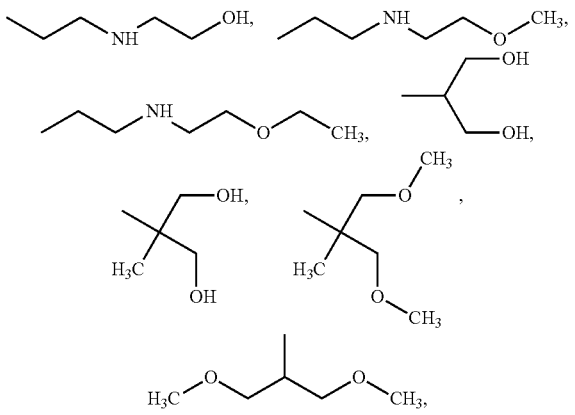

$—(C_2H_4O)_n—H$, $—(C_2H_4O)_n—CH_3$, $—(C_2H_4O)_n—C_2H_5$, $—(C_3H_6O)_n—H$, $—(C_3H_6O)_n—CH_3$, $—(C_3H_6O)_n—C_2H_5$ with, in each case, n=1 to 20, in particular 2 to 10, and mixtures thereof. In preferred units of general formula I, $R^1$=H and $R^2$≠H. Preferred groups $—NR^1R^2$ also derive from amino alcohols, such as 2-aminoethanol, 3-aminopropanol, 2-(2-aminoethoxy)ethanol, N-2-(2-hydroxyethyl)ethylene diamine, (2-methoxyethyl)methylamine, (2-ethoxyethyl)methylamine, 2-amino-1,3-propanediol, 2-amino-2-methyl-1,3-propanediol, 2-amino-2-ethyl-1,3-propanediol, tris-(hydroxymethyl)aminomethane, N-aminomorpholine, N-aminoalkyl-morpholine, polyalkoxylated and in particular ethoxylated amines, aniline, which can be substituted at the ring as desired, benzylamine, which can be substituted at the ring as desired, such as p-aminobenzylamine, and mixtures thereof. Preferred groups $—NR^1R^2$, in which $R^1$ and $R^2$, together with the N atom to which they are bonded, form a 4 to 7-membered aliphatic or aromatic ring, in particular a 5 or 6-membered ring, derive from tetrahydropyrrole, piperidine, oxazolidine, morpholine, imidazolidine, piperazine, thiazolidine, tetrahydro-1,4-thiazine, and mixtures thereof. Particularly preferred groups $R^1$ and/or $R^2$ include methyl, ethyl, propyl, 2-hydroxyethyl, 3-hydroxypropyl, 2-methoxyethyl, 2-ethoxyethyl,

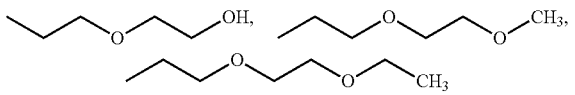

and mixtures thereof.

Besides the modified anhydroglucose unit of general formula I, the cellulose derivative to be used in accordance with the invention contains anhydroglucose units linked 1,4-β-glycosidically therewith, which are free from the 6-desoxy-6-amino modification and which can be unsubstituted or likewise modified such that they correspond to general formula I apart from the absent 6-desoxy-6-amino modification. If desired, as in the units of formula (I), O-substituents in the anhydroglucose units free from 6-amino substituents can also carry $R^1$ and/or $R^2$, which include, for example, alkyl groups, such as methyl or ethyl groups, hydroxyalkyl groups, such as hydroxyethyl or hydroxypropyl groups, or oligoethoxyethyl or oligopropoxypropyl groups, carboxyalkyl groups, such as carboxymethyl or carboxyethyl groups, aminoalkyl groups, such as aminoethyl or trimethylammoniumethyl groups, sulfoalkyl groups, such as sulfoethyl or sulfopropyl groups, ester groups, such as acetic acid, β-aminopropionic acid, glycolic acid, malonic acid or p-toluene sulfonic acid ester groups. The average degree of substitution based on the proportion of 6-amino groups ($DS_{amine}$) in the cellulose derivative to be used in accordance with the invention lies preferably in the range of from 0.1 to 1, in particular 0.2 to 0.8. The average degree of substitution based on the proportion of 2- or 3-tosyl groups ($DS_{tosyl}$) in the cellulose derivative to be used in accordance with the invention preferably does not lie above 0.5, in particular in the range of from 0 to 0.25. If substituents at O atoms of the anhydroglucose units are present, the average degree of substitution, based on the proportion of groups of this kind, lies preferably beneath 1 and in particular beneath the degree of substitution for the 6-desoxy-6-amino groups. In embodiments of the invention there are no modifications contained in the cellulose derivative to be used in accordance with the invention going beyond the introduction of the 6-desoxy-6-amino group and, as applicable, of the tosylate group.

A further subject of the invention is a method for laundering textiles, in which a detergent and a soil release active ingredient are used in the form of a cellulose derivative as defined above. These methods can be performed manually or as appropriate with the aid of a conventional domestic washing machine. Here, it is possible to apply the detergent and the soil release active ingredient at the same time or one after the other. Application at the same time can be implemented particularly advantageously by use of a detergent containing the soil release active ingredient. The method relies fundamentally in bringing a textile requiring cleaning or at least the soiled part of the surface thereof into contact with an aqueous preparation containing the above-defined cellulose derivative, leaving the aqueous preparation to act for a certain time on the textile or at least the soiled part of the surface thereof, and removing the aqueous preparation, for example by rinsing the textile with water.

The effect of the active ingredient to be used in accordance with the invention is particularly pronounced with multiple application, that is to say in particular for the removal of stains on textiles that had already been washed and/or aftertreated in the presence of the active ingredient before they became stained. In conjunction with the aftertreatment, it should be noted that the referenced positive aspect can also be provided by a washing process in which the textile, after the actual washing process, which is performed with the aid of a detergent which can contain an active ingredient as described, but in this case can also be free from such an active ingredient, is brought into contact with a aftertreatment agent, for example within the scope of a fabric softening step, containing an active ingredient that is to be used in accordance with the invention, in the presence of water. In the case of this approach as well, the washing-performance-enhancing effect of the active ingredients to be used in accordance with the invention is provided during the next washing process, even if once again a detergent without an active substance to be used in accordance with the invention is used as desired. This effect is much greater than achieved with use of a conventional soil release active ingredient. In a particularly preferred embodiment, the active ingredient essential to the invention is added in the fabric softening process of the textile laundering, performed in particular by machine.

The active ingredient used in accordance with the invention leads to a significantly improved detachment in particular of greasy and cosmetic stains on textiles, in particular on textiles produced from cotton or cotton-containing fabric, compared to that achieved with use of compounds known previously for this purpose. Alternatively, with constant grease-removing capability, significant amounts of surfactants can be spared.

In addition, it has been observed that, in the presence of the cellulose derivatives essential to the invention in the laundering process, there is a lower redeposition of dirt already removed from the textile on the cleaned textile, and therefore the textiles washed in the presence of a cellulose derivative are essential to the invention become grayed to a much lesser extent than those washed in the absence of the cellulose derivative essential to the invention. A further subject of the invention is therefore the use of the above-defined cellulose derivatives in order to reduce the graying of textiles during laundering.

The uses according to the invention can be provided within the scope of a laundering process, in such a way that the soil release active ingredient is added to a detergent-containing washing liquor or preferably introduces the active ingredient as part of a detergent into the washing liquor, which contains the item to be cleaned or is brought into contact therewith. Further subjects of the invention are therefore detergents containing the above-defined cellulose derivatives.

The use according to the invention within the scope of a laundry aftertreatment process can be implemented accordingly in such a way that the soil release active ingredient is added separately to the rinsing water, which is used after the washing process performed with application of a detergent, or it is introduced as part of the laundry aftertreatment agent, in particular a fabric softener. In this aspect of the invention, the detergent used before the laundry aftertreatment agent can also contain an active ingredient to be used in accordance with the invention, but can also be free therefrom.

The washing process is preferably performed at a temperature of from 15° C. to 60° C., particularly preferably at a temperature of from 20° C. to 40° C. The washing process is also preferably performed at a pH value of from 6 to 11, particularly preferably at a pH value of from 7.5 to 9.5. The concentration at which the cellulose derivative is used in the washing liquor is preferably 0.0001 g/L to 1 g/L, in particular 0.001 g/L to 0.2 g/L.

Products that contain an active ingredient to be used in accordance with the invention in the form of the described cellulose derivative or which are used together therewith or are employed in methods according to the invention can contain all conventional other constituents of products of this kind which do not interact undesirably with the active ingredient essential to the invention, in particular surfactant. The above-defined active ingredient is preferably used in amounts of from 0.05 wt. % to 10 wt. %, particularly preferably from 0.2 wt. % to 3 wt. %, wherein these and amounts specified further below relate to the product as a whole, unless specified otherwise.

It has surprisingly been found that the active ingredient used in accordance with the invention positively influences the effect of certain other detergent ingredients and that, conversely, the effect of the soil release active ingredient is additionally enhanced by certain other detergent ingredients. These effects are observed in particular in the case of bleaching agents, in enzymatic active ingredients, in particular proteases and lipases, in water-soluble inorganic and/or organic builders, in particular based on oxidized carbohydrates or polymer polycarboxylates, in synthetic anion surfactants of the sulfate and sulfonate type, and in dye transfer inhibitors, for example vinylpyrrolidone, vinylpyridine, or vinylimidazole polymers or copolymers or corresponding polybetaines, and therefore the use of at least one of the aforesaid further ingredients together with the active ingredient to be used in accordance with the invention is preferred.

A product that contains an active ingredient to be used in accordance with the invention or that is used together therewith or that is used in the method according to the invention preferably contains bleaching agent based on peroxygen, in particular in amounts ranging from 5 wt. % to 70 wt. %, and as appropriate bleach activator, in particular in amounts ranging from 2 wt. % to 10 wt. %, but in another preferred embodiment can also be free from bleaching agent and bleach activator. The bleaching agents under consideration are preferably the peroxygen compounds generally used in detergents, such as percarboxylic acids, for example Dodecanese diperacid or phthaloylaminoperoxicaproic acid, hydrogen peroxide, alkaliperborate, which can be present as tetra- or monohydrate, percarbonate perpyrophosphate and persilicate, which generally are present in the form of alkali salts, in particular in the form of sodium salts. Bleaching agents of this type are contained in detergents containing an active ingredient used in accordance with the invention, preferably in amounts of up to 25 wt. %, in particular up to 15 wt. %, and particularly preferably from 5 wt. % to 15 wt. %, in each case in relation to the total product, wherein percarbonate is used in particular. The optionally present component of the bleach activators comprises the usually used N- or O-acyl compounds, for example multiple acylated alkylene diamines, in particular tetraacetylethylene diamine, acylated glycolurils, in particular tetracetylglycoluril, N-acylated hydantoins, hydracids, triazoles, urazoles, diketopiperazines, sulfuryl amides, and cyanurates, additionally carboxylic acid anhydrides, in particular phthalic acid anhydride, carboxylic acid esters, in particular sodium isononanoyl phenol sulfonate, and acylated sugar derivatives, in particular pentaacetyl glucose, and also cationic nitrile derivatives, such as trimethylammonium acetonitrile salts. The bleach activators may have been coated in the known manner with enveloping substances in order to prevent interaction with the peroxygen compounds during storage, and/or may have been granulated, wherein tetraacetylethylenediamine granulated with the aid of carboxymethyl cellulose and having average particle sizes of from 0.01 mm to 0.8 mm, granulated 1,5-diacetyl-2,4-dioxohexahydro-1,3,5-triazine and/or trialkyl ammonium acetonitrile in particle form is particularly preferred. Bleach activators of this type are contained in detergents preferably in amounts of up to 8 wt. %, in particular from 2 wt. % to 6 wt. %, in each case in relation to the total product.

In a preferred embodiment a product used in accordance with the invention or employed in the method according to the invention contains non-ionic surfactant, selected from fatty alkyl polyglycosides, fatty alkyl polyalkoxylates, in particular ethoxylates and/or propoxylates, fatty acid polyhdroxy amides and/or ethoxylation and/or propoxylation products of fatty alkyl amines, vicinal diols, fatty acid alkyl esters and/or fatty acid amides and mixtures thereof, in particular in an amount ranging from 2 wt. % to 25 wt. %.

A further embodiment of products of this kind comprises the presence of synthetic anionic surfactant of the sulfate and/or sulfonate type, in particular fatty alkyl sulfate, fatty alkyl ether sulfate, sulfofatty acid esters and/or sulfofatty acid disalts, in an amount ranging from 2 wt. % to 25 wt. %. The anionic surfactant is preferably selected from the alkyl or alkenyl sulfates and/or the alkyl or alkenyl ether sulfates, in which the alkyl or alkenyl group has 8 to 22, in particular 12 to 18 C atoms. These are not usually individual substances, but cuts or mixtures. Those of which the proportion of compounds having longer-chain groups ranging from 16 to 18 C atoms is more than 20 wt. % are preferred.

Potential non-ionic surfactants include the alkoxylates, in particular the ethoxylates and/or propoxylates of saturated or mono- to polyunsaturated linear or branch-chained alcohols having 10 to 22 C atoms, preferably 12 to 18 C atoms. Here, the degree of alkoxylation of the alcohols is generally between 1 and 20, preferably between 3 and 10. They can be produced in the known manner by reacting the corresponding alcohols with the corresponding alkylene oxides. In particular, the derivatives of the fatty alcohols are suitable, although the branch-chained isomers thereof, in particular what are known as oxoalcohols, can also be used for the preparation of usable alkoxylates. Accordingly, the alkoxylates, in particular the ethoxylates, of primary alcohols with linear, in particular dodecyl, tetradecyl, hexadecyl or octadecyl groups as well as mixtures thereof can be used. In addition, appropriate alkoxylation products of alkylamines, vicinal diols, and carboxylic acid amides which correspond in terms of the alkyl part to the specified alcohols can be used. In addition, the ethylene oxide and/or propylene oxide insertion products of fatty acid alkyl esters and also fatty acid polyhydroxyamides can be considered. So-called 'alkyl polyglycosides' suitable for incorporation into the products according to the invention are compounds of general formula $(G)_n$-$OR^{12}$, in which $R^{12}$ means an alkyl or alkenyl group having 8 to 22 C atoms, G means a glucose unit, and n means a number between 1 and 10. The glycoside component $(G)_n$ is composed of oligomers or polymers from naturally occurring aldose or ketose monomers, including in particular glucose, mannose, fructose, galactose, talose, gulose, altrose, allose, idose, ribose, arabinose, xylose and lyxose. The oligomers consisting of glycosidically linked monomers of this type are additionally characterized by the type of sugars contained therein, by the number thereof, and by what is known as the degree of oligomerization. The degree of oligomerization n generally assumes fractional numerical values as a variable that is to be determined analytically; it lies at values between 1 and 10, at which glycosides used with preference are below a value of 1.5, in particular between 1.2 and 1.4. A preferred monomer unit is glucose due to the good availability. The alkyl or alkenyl part $R^{12}$ of the glycosides preferably also originates from easily accessible derivatives of renewable raw materials, in particular from fatty alcohols, although the branch-chained isomers thereof, in particular what are known as oxoalcohols, can also be used for the preparation of usable glycosides. In particular, the primary alcohols with linear octyl, decyl, dodecyl, tetradecyl, hexadecyl or octadecyl groups and also mixtures thereof can be used accordingly. Particularly preferred alkylglycosides contain a coconut oil alkyl group, that is to say mixtures with substantially $R^{12}$=dodecyl and $R^{12}$=tetradecyl.

Non-ionic surfactant is used in products that contain a soil release active ingredient used in accordance with the invention, that are used in accordance with the invention or that are employed in the method according to the invention, preferably in amounts of from 1 wt. % to 30 wt. %, in particular from 1 wt. % to 25 wt. %, wherein amounts in the upper part of this range tend to be encountered in liquid detergents, whereas particulate detergents preferably tend to contain lower amounts of up to 5 wt. %.

The products can contain further surfactants instead or additionally, preferably synthetic anionic surfactants of the sulfate or sulfonate type, such as alkylbenzene sulfonates, in amounts of preferably not more than 20 wt. %, in particular from 0.1 wt. % to 18 wt. %, in each case in relation to the product as a whole. The alkyl and/or alkenyl sulfates having 8 to 22 C atoms which carry an alkali-, ammonium- or alkyl- or hydroxyalkyl-substituted ammonium ion as counter-cation can be cited as synthetic anionic surfactants particularly suitable for use in products of this type. The derivatives of the fatty alcohols having in particular 12 to 18 C atoms and the branch-chained analogues thereof, or what are known as the oxoalcohols, are preferred. The alkyl and alkenyl sulfates can be produced in the known manner by reacting the corresponding alcohol components with a conventional sulfation reagent, in particular sulfur trioxide or chlorosulfonic acid, and subsequent neutralization with alkali-, ammonium-, or alkyl- or hydroxyalkyl-substituted ammonium bases. The usable surfactants of the sulfate type also include the sulfated alkoxylation products of the specified alcohols, or what are known as ether sulfates. Ether sulfates of this type preferably contain 2 to 30, in particular 4 to 10 ethylene glycol groups per molecule. The suitable anionic surfactants of the sulfonate type include the α-sulfoesters obtainable by reacting fatty acid esters with sulfur trioxide and by subsequent neutralization, in particular the sulfonation products deriving from fatty acids having 8 to 22 C atoms, preferably 12 to 18 C atoms, and linear alcohols having 1 to 6 C atoms, preferably 1 to 4 C atoms, and also the sulfofatty acids arising from these as a result of formal saponification.

Soaps can be considered as further optional surfactant ingredients, wherein saturated fatty acid soaps, such as salts of lauric acid, myristic acid, palmitic acid or stearic acid, and also soaps derived from natural fatty acid mixtures, for example coconut, palm kernel or tallow fatty acids, are suitable. In particular, soap mixtures which are composed to an extent of up to 50 wt. % to 100 wt. % of saturated $C_{12}$-$C_{15}$ fatty acid soaps and up to 50 wt. % of oleic acid soaps are preferred. Soap is preferably contained in amounts of from 0.1 wt. % to 5 wt. %. However, higher soap amounts of generally up to 20 wt. % can also be contained in particular in liquid products containing a polymer used in accordance with the invention.

If desired, the products can also contain betaine surfactants and/or cationic surfactants, which, if present, are preferably used in amounts of from 0.5 wt. % to 7 wt. %. Among these, the esterquats discussed below are particularly preferred.

In a further embodiment the product contains water-soluble and/or water-insoluble builder, in particular selected from alkali aluminosilicate, crystalline alkali silicate with modulus greater than 1, monomeric polycarboxylate, polymeric polycarboxylate, and mixtures thereof, in particular in amounts ranging from 2.5 wt. % to 60 wt. %.

The product preferably contains 20 wt. % to 55 wt. % of water-soluble and/or water-insoluble, organic and/or inorganic builder. In particular, water-soluble organic builder substances include those from the class of polycarboxylic acids, in particular citric acid and sugar acids, and also the polymeric (poly)carboxylic acids, in particular the polycarboxylates accessible by oxidation of polysaccharides, polymeric acrylic acids, methacrylic acids, maleic acids, and mixed polymers thereof, which can also contain, polymerized therein, small proportions of polymerizable substances without carboxylic acid functionality. The relative molecular mass of the homopolymers of unsaturated carboxylic acids generally lies between 5,000 g/mol and 200,000 g/mol, and that of the copolymers between 2,000 g/mol and 200,000 g/mol, preferably 50,000 g/mol to 120,000 g/mol, in relation to free acid. A particularly preferred acrylic acid-maleic acid copolymer has a relative molecular mass of from 50,000 g/mol to 100,000 g/mol. Suitable, although less preferred compounds of this class are copolymers of acrylic acid or methacrylic acid with vinyl ethers, such as vinyl methyl ethers, vinyl esters, ethylene, propylene and styrene, in which the proportion of the acid is at least 50 wt. %. Terpolymers which contain, as monomers, two carboxylic acids and/or salts thereof and which contain, as third monomer, vinyl alcohol and/or a vinyl alcohol derivative or a carbohydrate can also be used as water-soluble organic builder substances. The first acid monomer or salt thereof derives from a monoethylenically unsaturated $C_3$-$C_8$ carboxylic acid and preferably from a $C_3$-$C_4$ monocarboxylic acid, in particular from (meth)acrylic acid. The second acid monomer or salt thereof can be a derivative of a $C_4$-$C_8$ dicarboxylic acid, wherein maleic acid is particularly preferred. The third monomer unit is in this case formed by vinyl alcohol and/or preferably an esterified vinyl alcohol. In particular, vinyl alcohol derivatives which constitute an ester formed of short-chain carboxylic acids, for example $C_1$-$C_4$ carboxylic acids, with vinyl alcohol are preferred. Preferred terpolymers here contain 60 wt. % to 95 wt. %, in particular 70 wt. % to 90 wt. % of (meth)acrylic acid and/or (meth) acrylate, particularly preferably acrylic acid and/or acrylate, and maleic acid and/or maleinate and also 5 wt. % to 40 wt. %, preferably 10 wt. % to 30 wt. % of vinyl alcohol and/or vinyl acetate. Here, terpolymers in which the ratio by weight of (meth)acrylic acid and/or (meth)acrylate to maleic acid and/or maleate is between 1:1 and 4:1, preferably between 2:1 and 3:1 and in particular 2:1 and 2.5:1 are very particularly preferred. Here, both the amounts and the ratios by weight are based on the acids. The second acid monomer or salt thereof can also be a derivative of an allylsulfonic acid which in the 2 position is substituted with an alkyl group, preferably with a $C_1$-$C_4$ alkyl group, or an aromatic group that derives preferably from benzene or benzene derivatives. Preferred terpolymers here contain 40 wt. % to 60 wt. %, in particular 45 to 55 wt. % of (meth)acrylic acid and/or (meth)acrylate, particularly preferably acrylic acid and/or acrylate, 10 wt. % to 30 wt. %, preferably 15 wt. % to 25 wt. % of methallylsulfonic acid and/or methallysulfonate, and, as third monomer, 15 wt. % to 40 wt. %, preferably 20 wt. % to 40 wt. % of a carbohydrate. This carbohydrate here can be a mono-, di-, oligo- or polysaccharide for example, wherein mono-, di- or oligosaccharides are preferred, with sucrose being particularly preferred. Due to the use of the third monomer, predetermined breaking points should be incorporated in the polymer and are responsible for the good biological degradability of the polymer. These terpolymers generally have a relative molecular mass between 1,000 g/mol and 200,000 g/mol, preferably between 3,000 g/mol and 10,000 g/mol. They can be used in the form of aqueous solutions, preferably in the form of 30 to 50 wt. % aqueous solutions, in particular for the production of liquid products. All specified polycarboxylic acids are generally used in the form of their water-soluble salts, in particular their alkali salts.

Organic builder substances of this type are preferably contained in amounts of up to 40 wt. % in particular up to 25 wt. %, and particularly preferably from 1 wt. % to 5 wt. %. Amounts close to the specified upper limits are preferably used in pasty or liquid, in particular water-containing products.

In particular, crystalline or amorphous alkali aluminosilicates are used as water-insoluble, water-dispersible inorganic builder materials, in amounts of up to 50 wt. %, preferably not more than 40 wt. %, and in liquid products are used in particular from 1 wt. % to 5 wt. %. Among these, the crystalline aluminosilicates of detergent quality, in particular zeolite NaA and optionally NaX, are preferred. Amounts close to the specified upper limits are preferably used in solid, particulate products. Suitable aluminosilicates in particular have no particles having a particle size of more than 30 m and preferably consist to an extent of at least 80 wt. % of particles having a size of less than 10 μm. Their calcium bonding capability, which can be determined in accordance with the details in German patent application DE 24 12 837, lies in the range of from 100 to 200 mg of CaO per gram. Suitable substitutes or partial substitutes for the specified aluminosilicate are crystalline alkali silicates, which can be present alone or mixed with amorphous silicates. The alkali silicates usable in the products as builder substances preferably have a molar ratio of alkali oxide to $SiO_2$ of less than 0.95, in particular from 1:1.1 to 1:12 and can be present in amorphous or crystalline form. Preferred alkali silicates are the sodium silicates, in particular the amorphous sodium silicates, with a molar ratio of $Na_2O:SiO_2$ of from 1:2 to 1:2.8. Such amorphous alkali silicates are commercially obtainable for example under the name Portil®. They are added preferably as a solid and not in the form of a solution within the scope of the production process. Crystalline sheet silicates of general formula $Na_2Si_xO_{2x+1}.yH_2O$, in which x, or what is known as the modulus, is a number from 1.9 to 4 and y is a number from 0 to 20 and preferred values for x are 2, 3 or 4, are preferably used as crystalline silicates, which can be present alone or mixed with amorphous silicates. Preferred crystalline sheet silicates are those in which x in the specified general formula assumes the values 2 or 3. In particular, both β- and δ-sodium disilicates ($Na_2Si_2O_5.yH_2O$) are preferred. Practically anhydrous, crystalline alkali silicates of the above-mentioned general formula in which x means a number from 1.9 to 2.1 produced from amorphous alkali silicates can also be used in products which contain an active ingredient to be used in accordance with the invention. In a further preferred embodiment of products according to the invention, a crystalline sodium sheet silicate having a modulus of from 2 to 3 is used, as can be produced from sand and soda. Crystalline sodium silicates having a modulus ranging from 1.9 to 3.5 are used in a further preferred embodiment of detergents containing an active ingredient used in accordance with the invention. The content thereof of alkali silicates is preferably 1 wt. % to 50 wt. %, and in particular 5 wt. % to 35 wt. %, in relation to anhydrous active substance. If alkalialuminosilicate, in particular zeolite, is provided as additional builder substance, the content of alkali silicate is preferably 1 wt. % to 15 wt. % and in particular 2 wt. % to 8 wt. %, in relation to anhydrous active substance. The ratio by weight of aluminosilicate to silicate, in each case in relation to anhydrous active substances, is then preferably 4:1 to 10:1. In products that contain both amorphous and crystalline alkalisilicates, the ratio by weight of amorphous alkalisilicate to crystalline alkalisilicate is preferably 1:2 to 2:1 and in particular 1:1 to 2:1.

In addition to the mentioned inorganic builder, further water-soluble or water-insoluble inorganic substances can be contained in the products that contain an active ingredient to be used in accordance with the invention, that are used together therewith, or that are employed in methods according to the invention. In this context, the alkali carbonates, alkali hydrogen carbonates, and alkali sulfates and mixtures thereof are suitable. Additional inorganic material of this type can be provided in amounts up to 70 wt. %.

In addition, the products can contain further constituents that are conventional in detergents or cleaning products. These optional constituents include in particular enzymes, enzyme stabilizers, complexing agents for heavy metals, for example amino polycarboxylic acids, amino hydroxyl polycarboxylic acids, polyphosphonic acids and/or amino polyphosphonic acids, foam inhibitors, for example organopolysiloxanes or paraffins, solvents and optical brighteners, for example stilbene disulfonic acid derivatives. Optical brighteners, in particular compounds from the class of substituted 4,4'-bis-(2,4,6-triamino-s-triazinyl)-stilbene-2,2'-disulfonic acids, up to 5 wt. %, in particular 0.1 wt. % to 2 wt. %, of complexing agents for heavy metals, in particular aminoalkylene phosphonic acids and salts thereof, and up to 2 wt. %, in particular 0.1 wt. % to 1 wt. %, of foam inhibitors are preferably contained in products that contain an active ingredient used in accordance with the invention, wherein the specified proportions by weight relate in each case to total product.

In addition to water, solvents which in particular can be used in the case of liquid products are preferably those which can be mixed with water. These include the lower alcohols, for example ethanol, propanol, isopropanol, and the isomeric butanols, glycerol, lower glycols, for example ethylene and propylene glycol, and the ethers derivable from the specified compound classes. The active ingredients used in accordance with the invention are generally present in such liquid products in dissolved or suspended form.

Enzymes, which are present optionally, are preferably selected from the group comprising proteases, amylases, lipases, cellulases, hemicellulases, oxidases, peroxidases, pectinases and mixtures thereof. Proteases obtained from microorganisms such as bacteria or fungi are primarily considered. They can be obtained from suitable microorganisms by fermentation processes, as is known. Proteases are commercially obtainable for example under the names BLAP®, Savinase®, Esperase®, Maxatase®, Optimase®, Alcalase®, Durazym® or Maxapem®. The usable lipases can be obtained for example from *Humicola lanuginosa*, from *Bacillus* types, from *Pseudomonas* types, from *Fusarium* types, from *Rhizopus* types, or from *Aspergillus* types. Suitable lipases are commercially obtainable for example under the names Lipolase®, Lipozym®, Lipomax®, Lipex®, Amano® lipase, Toyo-Jozo® lipase, Meito® lipase and Diosynth® lipase. Suitable amylases are commercially available for example under the names Maxamyl®, Termamyl®, Duramyl® and Purafect® OxAm. The usable cellulases can be an enzyme obtainable from bacteria or fungi, which enzyme has a pH optimum preferably in the weakly acidic to weakly alkaline range from 6 to 9.5. Cellulases of this type are commercially obtainable under the names Celluzyme®, Carezyme® and Ecostone®.

The conventional enzyme stabilizers optionally present, in particular in liquid products, include amino alcohols, for example mono-, di-, triethanol and -propanol amine and mixtures thereof, lower carboxylic acids, boric acid, alkali borates, boric acid-carboxylic acid combinations, boric acid esters, boric acid derivatives, calcium salts, for example Ca-formic acid combination, magnesium salts, and/or sulfur-containing reducing agents.

Suitable foam inhibitors include long-chain soaps, in particular behenic soaps, fatty acid amides, paraffins, waxes, microcrystalline waxes, organopolysiloxanes, and mixtures thereof, which additionally can contain micro-fine, optionally silanized or otherwise waterproofed silica. Foam inhibitors of this type are preferably bound to granular, water-soluble carrier substances for use in particulate products.

In a further preferred embodiment a product in which the active ingredient to be used in accordance with the invention is incorporated is provided in the form of particles and contains up to 25 wt. %, in particular 5 wt. % to 20 wt. % of bleaching agent, in particular alkali percarbonate, up to 15 wt. %, in particular 1 wt. % to 10 wt. % of bleach activator, 20 wt. % to 55 wt. % of inorganic builder, up to 10 wt. %, in particular 2 wt. % to 8 wt. % of water-soluble organic builder, 10 wt. % to 25 wt. % of synthetic anionic surfactant, 1 wt. % to 5 wt. % of non-ionic surfactant, and up to 25 wt. %, in particular 0.1 wt. % to 25 wt. % of inorganic salts, in particular alkali carbonate and/or alkali hydrogen carbonate.

In a further preferred embodiment a product in which the active ingredient to be used in accordance with the invention is incorporated is liquid and contains 1 wt. % to 25 wt. %, in particular 5 wt. % to 15 wt. % of non-ionic surfactant, up to 10 wt. %, in particular 0.5 wt. % to 8 wt. % of synthetic anionic surfactant, 3 wt. % to 15 wt. %, in particular 5 wt. % to 10 wt. % of soap, 0.5 wt. % to 5 wt. %, in particular 1 wt. % to 4 wt. % of organic builder, in particular polycarboxylate such as citrate, up to 1.5 wt. %, in particular 0.1 wt. % to 1 wt. % of complexing agent for heavy metals, such as phosphonate, and additionally optionally contained enzyme, enzyme stabilizer, dye and/or fragrance, water and/or water-miscible solvent.

DETAILED DESCRIPTION OF THE INVENTION

The use of a combination of a soil release active ingredient essential to the invention with a soil release polymer formed from a dicarboxylic acid and a potentially polymeric diol to enhance the cleaning performance of detergents during the laundering of textiles is also possible. Such combinations with a polymer which in particular is a polyester-active dirt release polymer are also possible within the scope of products according to the invention and the method according to the invention.

The known polyester-active soil release polymers, which can be used in addition to the active ingredients essential to the invention, include copolyesters of dicarboxylic acids, for example adipic acid, phthalic acid or terephthalic acid, diols, for example ethylene glycol or propylene glycol, and polydiols, for example polyethylene glycol or polypropylene glycol. The soil release polymers that are used with preference include compounds which are formally accessible by esterification of two monomer parts, wherein the first monomer is a dicarboxylic acid HOOC-Ph-COOH and the second monomer is a diol $HO—(CHR^{11}—)_aOH$, which can also be present in the form of a polymeric diol $H—(O—(CHR^{11})_a)_bOH$. Therein, Ph means an o-, m- or p-phenyl group, which can carry 1 to 4 substituents, selected from alkyl groups having 1 to 22 C atoms, sulfonic acid groups, carboxyl groups, and mixtures thereof, $R^{11}$ is hydrogen, an alkyl group having 1 to 22 C atoms and mixtures thereof, a is a number from 2 to 6, and b is a number from 1 to 300. In the polyesters obtainable therefrom, there are preferably present both monomer diol units $—O—(CHR^{11}—)_aO—$ and polymer diol units $—(O—(CHR^{11}—)_a)_bO—$. The molar ratio of monomer diol units to polymer diol units is preferably 100:1 to 1:100, in particular 10:1 to 1:10. In the polymer diol units, the degree of polymerization b preferably lies in a range of from 4 to 200, in particular from 12 to 140. The molecular weight or the mean molecular weight or the maximum of the molecular weight distribution of preferred soil release polyesters lies in a range of from 250 g/mol to 100,000 g/mol, in particular from 500 g/mol to 50,000 g/mol. The acid forming the basis of the group Ph is preferably selected from terephthalic acid, isophthalic acid, phthalic acid, trimellitic acid, mellitic acid, the isomers of sulfophthalic acid, sulfoisophthalic acid, and sulfoterephthalic acid and mixtures thereof. Provided the acid groups thereof are not part of the ester bonds in the polymer, they are preferably present in salt form, in particular as alkali salt or ammonium salt.

Among these, the sodium and potassium salts are particularly preferred. If desired, small proportions, in particular no more than 10 mol % in relation to the proportion of Ph with the above-mentioned meaning, of other acids comprising at least two carboxyl groups, can be contained in the soil release polyester instead of the monomer HOOC-Ph-COOH. These other acids for example include alkylene and alkenyl dicarboxylic acids, such as malonic acid, succinic acid, fumaric acid, maleic acid, glutaric acid, adipic acid, pimelic acid, suberic acid, azelaic acid, and sebacic acid. The preferred diols HO—$(CHR^{11}—)_a$OH include those in which $R^{11}$ is hydrogen and a is a number from 2 to 6, and those in which a has the value 2 and $R^{11}$ is selected from hydrogen and the alkyl groups having 1 to 10, in particular 1 to 3 C atoms. Among the last-mentioned diols, those of formula HO—$CH_2$—$CHR^{11}$—OH, in which $R^{11}$ has the above-mentioned meaning, are particularly preferred. Examples of diol components are ethylene glycol, 1,2-propylene glycol, 1,3-propylene glycol, 1,4-butanediol, 1,5-pentanediol, 1,6-hexanediol, 1,8-octanediol, 1,2-decanediol, 1,2-dodecanediol and neopentyl glycol. Among the polymeric diols, polyethylene glycol having a mean molar mass ranging from 1,000 g/mol to 6,000 g/mol is particularly preferred.

If desired, these polyesters composed as described above can also be end-group-terminated, wherein alkyl groups having 1 to 22 C atoms and esters of monocarboxylic acids are potential end groups. The end groups bound via ester bonds can be based on alkyl, alkenyl and aryl monocarboxylic acids having 5 to 32 C atoms, in particular 5 to 18 C atoms. These include valeric acid, caproic acid, enanthic acid, caprylic acid, pelargonic acid, capric acid, undecanoic acid, undecenoic acid, lauric acid, lauroleic acid, tridecanoic acid, myristic acid, myristoleic acid, pentadecanoic acid, palmitic acid, stearic acid, petroselinic acid, petroselaidic acid, oleic acid, linoleic acid, linolaidic acid, linolenic acid, elaostearic acid, arachinic acid, gadoleic acid, arachidonic acid, behenic acid, erucic acid, brasidinic acid, clupanodonic acid, lignoceric acid, cerotic acid, melissic acid, benzoic acid, which can carry 1 to 5 substituents with a total of up to 25 C atoms, in particular 1 to 12 C atoms, for example tert.-butylbenzoic acid. The end groups can also be based on hydroxymonocarboxylic acids having 5 to 22 C atoms, including for example hydroxyvaleric acid, hydroxycaproic acid, ricolinic acid, the hydrogenation product thereof hydroxystearic acid, and o-, m- and p-hydroxybenzoic acid. The hydroxymonocarbxylic acids can in turn be bound to one another via their hydroxyl group and their carboxyl group and thus can be present multiple times in an end group. The number of hydroxymonocarboxylic acid units per end group, i.e. their degree of oligomerization, preferably lies in the range of from 1 to 50, in particular from 1 to 10. In a preferred embodiment of the invention, polymers formed of ethylene terephthalate and polyethylene oxide terephthalate, in which the polyethylene glycol units have molecular weights of from 750 g/mol to 5,000 g/mol and the molar ratio of ethylene terephthalate to polyethylene oxide terephthalate is 50:50 to 90:10, are used in combination with an active ingredient essential to the invention.

The polyester-active soil release polymers are preferably water-soluble, wherein the term "water-soluble" shall be understood to mean a solubility of at least 0.01 g, preferably at least 0.1 g of the polymer per liter of water at room temperature, and pH 8. Polymers used with preference, however, have a solubility of at least 1 g per liter, in particular at least 10 g per liter, under these conditions.

Preferred laundry aftertreatment agents that contain an active ingredient to be used in accordance with the invention comprise what is known as an esterquat as laundry-softening active ingredient, in other words a quaternized ester from carboxylic acid and amino alcohol. These are known substances that can be obtained in accordance with the relevant preparatory methods known within the field of organic chemistry, for example by partially esterifying triethanolamine in the presence of hypophosphorous acid with fatty acids, passing air through, and then quaternizing with dimethyl sulfate or ethylene oxide. The production of solid esterquats is also known, in which case the quaternization of triethanol amine esters is performed in the presence of suitable dispersants, preferably fatty alcohols.

Preferred esterquats in the products are quaternized fatty acid triethanolamine ester salts of the following formula (IV)

(IV)

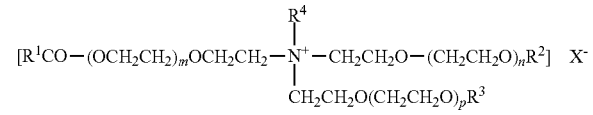

in which $R^1CO$ stands for an acyl group having 6 to 22 carbon atoms, $R^2$ and $R^3$, independently of one another, stand for hydrogen or $R^1CO$, $R^4$ stands for an alkyl group having 1 to 4 carbon atoms or a $(CH_2CH_2O)_qH$ group, m, n and p in total stand for 0 or numbers from 1 to 12, q stands for numbers from 1 to 12, and X stands for a charge-balancing anion, such as halide, alkyl sulfate or alkyl phosphate. Typical examples of esterquats that can be used within the sense of the invention are products based on caproic acid, caprylic acid, capric acid, lauric acid, myristic acid, isostearic acid, stearic acid, oleic acid, elaidic acid, arachinic acid, behenic acid and erucic acid and technical mixtures thereof, as are produced for example with the high-pressure splitting of natural fats and oils. Industrial $C_{12/18}$ coconut fatty acids and in particular partially hardened $C_{16/18}$ tallow or palm fatty acids and $C_{16/18}$ fatty acid cuts rich in elaidic acid are preferably used. In order to produce the quaternized esters, the fatty acids and the triethanolamine can be used generally in a molar ratio from 1.1:1 to 3:1. In view of the application properties of the esterquats, a ratio for use of from 1.2:1 to 2.2:1, preferably 1.5:1 to 1.9:1, has proven to be particularly advantageous. The esterquats used with preference are technical mixtures of mono-, di- and triesters with an average degree of esterification of from 1.5 to 1.9 and derive from industrial $C_{16/18}$ tallow or palm fatty acid (iodine value 0 to 40). Quaternized fatty acid triethanolamine ester salts of formula (IV), in which $R^1CO$ stands for an acyl group having 16 to 18 carbon atoms, $R^2$ stands for $R^1CO$, $R^3$ stands for hydrogen, $R^4$ stands for a methyl group, m, n and p stand for 0, and X stands for methyl sulfate, have proven to be particularly advantageous.

Besides the quaternized carboxylic acid triethanolamine ester salts, quaternized ester salts of carboxylic acids with diethanol alkyl amines of formula (V) can also be considered as esterquats (V)

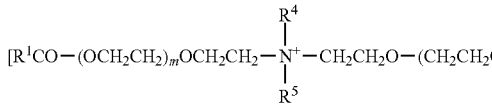

in which $R^1CO$ stands for an acyl group having 6 to 22 carbon atoms, $R^2$ stands for hydrogen, or $R^1CO$, $R^4$ and $R^5$, independently of one another, stand for alkyl groups having 1 to 4 carbon atoms, m and n in total stand for 0 or numbers from 1 to 12, and X stands for a charge-balancing anion, such as halide, alkyl sulfate or alkyl phosphate.

Lastly, a further group of suitable esterquats is constituted by the quaternized ester salts of carboxylic acids with 1,2-dihydroxypropyldialkyl amines of formula (VI)

(VI)

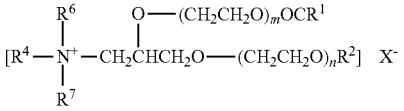

in which $R^1CO$ stands for an acyl group having 6 to 22 carbon atoms, $R^2$ stands for hydrogen, or $R^1CO$, $R^4$, $R^6$ and $R^7$, independently of one another, stand for alkyl groups having 1 to 4 carbon atoms, m and n in total stand for 0 or numbers from 1 to 12, and X stands for a charge-balancing anion, such as halide, alkyl sulfate or alkyl phosphate.

With regard to the selection of preferred fatty acids and the optimal degree of esterification, the details provided by way of example for (IV) also apply similarly for the esterquats of formulas (V) and (VI). The esterquats are usually commercially available in the form of 50 to 90 wt. % alcoholic solutions, which can also be diluted with water without difficulty, with ethanol, propanol and isopropanol being the usual alcoholic solvents.

Esterquats are preferably used in amounts of from 5 wt. % to 25 wt. %, in particular 8 wt. % to 20 wt. %, in each case in relation to the total laundry aftertreatment agent. If desired, the laundry aftertreatment agents used in accordance with the invention can additionally contain detergent ingredients as described above, provided they do not unreasonably interact negatively with the esterquat. A liquid, water-containing agent is preferred.

EXAMPLES

Example 1

Production of 6-desoxy-6-amino-cellulases a) Synthesis of ω-Methoxyethylamino Cellulose (Active Ingredient I)

50 g of tosyl cellulose (185 mmol), dissolved in 1 L DMSO were mixed, under stirring, with 50 mL 2-methoxyethylamine (575 mmol). The reaction solution was heated to 100° C. and, after a reaction time of 6 h, the product precipitated in 6 L of 2-propanol and the precipitate was removed by means of a G3 frit. The solid was washed three times with 1.5 L of 2-propanol. The product was then dissolved in 1 L of distilled water. The solution was freed from residues of 2-propanol by azeotropic distillation at 80 mbar. The solution was then mixed with the anion exchanger IRA-410 (Cl form) and stirred at room temperature for 18 h. The anion exchanger was filtered off, and the aqueous solution was lyophilized (8 days, −55 OC, 0.36 mbar).

Yield: 28 g (72%)

FT-IR (KBr): 3412 $cm^{-1}$ v (OH) 2894 $cm^{-1}$ v (CH) 1646 $cm^{-1}$ v (N—H) 1597 $cm^{-1}$ v (C═C) 1456 $cm^{-1}$ v ($CH_2$/$CH_3$) 1366 $cm^{-1}$ $v_{as}$ ($SO_2$) 1160 $cm^{-1}$ $v_s$ ($SO_2$) 1069 $cm^{-1}$ v (C—O—C)

1H-NMR [DMSO-$d_6$, 250 MHz]: 7.77 ppm-7.42 ppm ($H_{arom,t}$) 5.38 ppm-3.76 ppm (H1-H6 and OH) 3.38 ppm ($OCH_3$) 3.05 ppm ($CH_2$) 2.70 ppm ($CH_2$) 2.40 ppm ($CH_{3,t}$)

$^{13}$C-NMR [DMSO-$d_6$, 250 MHz]: 130.0 ppm (C—$H_m$) 128.2 ppm (C—$H_o$) 103.0 ppm (C-1) 100.9 ppm (C-1') 82.4 ppm 80.8 ppm 75.2 ppm 73.6 ppm (C-2-C-5) 71.8 ppm 71.5 ppm ($CH_2$) 60.6 ppm (C-6) 58.4 ppm ($OCH_3$) 49.7 ppm 48.8 ppm ($CH_2$) 21.6 ppm ($CH_{3,t}$)

Elemental analysis: C, 44.60% H, 6.83% N, 3.39% S, 1.33%

$DS_{EA,tosyl}$: 0.08 $D_{SE,\ amine}$: 0.49 b) Synthesis of ω-Methoxyethyl Methyl Amino Cellulose (Active Ingredient II)

50 g of tosyl cellulose (180 mmol) were dissolved in 850 mL DMSO. 59.8 mL of 2-methoxyethylmethylamine (550 mmol) were added to the clear solution. The reaction solution was stirred for 6 h at 100° C. The product was then precipitated in 7 L of acetone. The solid was separated over a G3 frit and washed 3 times with 1.5 L acetone. Once the product had dissolved in 1 L of distilled water, solvent residues were removed by azeotropic distillation at 80 mbar. The anion exchanger IRA-410 (Cl form) was then added, and the mixture was stirred at room temperature for 18 h. The anion exchanger was filtered off, and the aqueous solution was lyophilized (6 days, −55° C., 0.36 mbar).

Yield: 20 g (54%)

FT-IR: 3325 $cm^{-1}$ v (OH) 2880 $cm^{-1}$ v (CH) 1638 $cm^{-1}$ v (N—H) 1455 $cm^{-1}$ v ($CH_2$/$CH_3$) 1363 $cm^{-1}$ $v_{as}$ ($SO_2$) 1061 $cm^{-1}$ v (C—O—C)

$^1$H-NMR [DMSO-$d_6$, 250 MHz]: 7.78 ppm-7.44 ppm ($H_{arom,t}$) 5.42 ppm-3.78 ppm (H1-H6 and OH) 3.37 ppm ($OCH_3$) 3.07 ppm ($CH_2$) 2.66 ppm ($CH_2$) 2.31 ppm ($CH_3$)

$^{13}$C-NMR [DMSO-$d_6$, 250 MHz]: 129.6 ppm (C—$H_m$) 127.7 ppm (C—$H_o$) 102.6 ppm (C-1') 79.4 ppm 74.7 ppm 73.2 ppm 72.2 ppm (C-2-C-5) 69.7 ppm ($CH_2$) 59.9 ppm (C-$6_t$) 58.0 ppm ($OCH_3$) 56.5 ppm ($CH_2$) 42.9 ppm ($CH_3$) 21.1 ppm ($CH_{3,t}$)

Elemental analysis: C, 39.09% H, 5.85% N, 2.47% S, 0.92%

$DS_{EA,tosyl}$: 0.06 $DS_{EA,amine}$: 0.34

Example 2

Product

Table 1 shows the composition (ingredients in wt. %, in each case in relation to the product as a whole) of the detergents M1, M2 and M3 according to the invention and of the product VI free from a corresponding active ingredient:

TABLE 1

| Composition | V1 | M1 | M2 | M3 |
|---|---|---|---|---|
| $C_{9-13}$ alkylbenzene sulfonate, Na salt | 6 | 6 | 6 | 6 |
| Sodium lauryl ether sulfate with 2 EO | 8 | 8 | 8 | 8 |
| $C_{12-14}$ fatty alcohol with 7 EO | 6 | 6 | 6 | 6 |
| $C_{12-18}$ fatty acid, Na salt | 3 | 3 | 3 | 3 |
| NaOH | 2 | 2 | 2 | 2 |
| Citric acid | 2 | 2 | 2 | 2 |
| 1-hydroxyethan-1, 1-diphosphonate, Na salt | 0.2 | 0.2 | 0.2 | 0.2 |
| Enzyme, dye, opt. brightener, alcohols, boric acid | 5 | 5 | 5 | 5 |
| Active ingredient I[a)] | — | 1 | 1.5 | — |
| Active ingredient II[b)] | — | — | — | 1.5 |
| Water | to 100 | | | |

[a)]From example 1a; $R^1$ = H and $R^2$ = methoxyethyl with $DS_{amine}$ = 0.49 and $DS_{tosyl}$ = 0.08
[b)]From example 1b; $R^1$ = methyl and $R^2$ = methoxyethyl with $DS_{amine}$ = 0.34 and $DS_{tosyl}$ = 0.06

Example 3

Graying

The products V1 or M1 were tested in a Miele® W 1714 washing machine (cotton washing program, 40° C.; water hardness 16° dH; standardized dirt carrier; dosing 70 g of the particular product per washing cycle). Besides a full laundry load of 3.5 kg, the materials specified in the table (in each case 8 textile pieces measuring 20×40 cm) were also used.

The brightness values (Y values) of the materials after 3 washes under the specified conditions with the particular product are specified in Table 2.

TABLE 2

| Brightness values | | |
|---|---|---|
| Textile/Product | V1 | M1 |
| WFK 10A | 77.0 | 78.1 |
| WFK 12A terry cloth | 70.5 | 73.6 |
| EMPA 221 | 77.2 | 78.3 |
| T-Shirt (100% cotton) | 76.3 | 77.4 |

It can be seen that, with use of the product according to the invention, the materials gray to a lesser extent than with use of the product not containing the active ingredient essential to the invention.

Example 4

Clean textiles made of polyester (for stains A to E) or cotton (for stains F to H) were washed 3 times in a Miele® W 1514 washing machine at 40° C. in each case with 17 L of water of 16° dH per washing cycle with the detergent V1 specified in Example 2 or with the detergent M2 or M3 likewise specified there, in a dosing of, in each case, 4.1 g/L of washing lye, and were then air-dried. Standardized stains (A: dust/sebum; B: black shoe polish; C: engine oil; D: lard; E: lipstick; F: make-up; G: lard; mascara) were then applied to the test textiles, and the stains were aged for 7 days. The textiles prepared in this way were washed again with the detergent under the above-mentioned conditions at a laundry load of 3.5 kg (clean laundry plus test textiles). The assessment was performed by calorimetry; the mean values of the differences between the brightness values before and after washing between the products M2 or M3 and V1 (ΔΔMY values) from 6 tests are stated in Table 2.

TABLE 2

| Brightness differences ΔΔY | | |
|---|---|---|
| Stain/product | M2 | M3 |
| A | 8.3 | 11.2 |
| B | 17.0 | 13.7 |
| C | 4.9 | 3.9 |
| D | 2.4 | 2.4 |
| E | 5.1 | 5.5 |
| F | 6.5 | 5.7 |
| G | 3.1 | n.b. |
| H | n.b. | 6.4 |

n.b.: not determined

What is claimed is:

1. A detergent, comprising a cellulose derivative selected from the group consisting of ω-methoxyethylamino cellulose and ω-methoxyethyl methyl amino cellulose and wherein the detergent further comprises from 2 wt. % to 25 wt. % of a synthetic anionic surfactant, from 1 wt. % to 30 wt. % nonionic surfactant, and from 0.1 wt. % to 5 wt. % of saturated fatty acid soap.

2. The detergent according to claim 1, wherein it comprises the cellulose derivative in amounts of from 0.05 wt. % to 10 wt. %.

3. A method for laundering textiles, comprising a step wherein the detergent according to claim 1 is contacted with textiles in a washing liquor.

4. The method according to claim 3, wherein the concentration at which the cellulose derivative is used in the washing liquor is 0.0001 g/L to 1 g/L.

5. The method according to claim 4, wherein the concentration at which the cellulose derivative is used in the washing liquor is 0.001 g/L to 0.2 g/L.

* * * * *